United States Patent [19]

Yu et al.

[11] Patent Number: 4,709,747

[45] Date of Patent: Dec. 1, 1987

[54] PROCESS AND APPARATUS FOR REDUCING MACROSEGREGATION ADJACENT TO A LONGITUDINAL CENTERLINE OF A SOLIDIFIED BODY

[75] Inventors: Ho Yu; Douglas A. Granger, both of Murrysville, Pa.

[73] Assignee: Aluminum Company of America, Pittsburgh, Pa.

[21] Appl. No.: 899,492

[22] Filed: Aug. 22, 1986

Related U.S. Application Data

[63] Continuation-in-part of Ser. No. 774,887, Sep. 11, 1985, abandoned.

[51] Int. Cl.[4] ..... B22D 11/00

[52] U.S. Cl. ..... 164/487; 164/459; 164/418

[58] Field of Search ..... 164/459, 485, 487, 488, 164/133, 518, 437, 418

[56] References Cited

U.S. PATENT DOCUMENTS

| | | | |
|---|---|---|---|
| 3,464,812 | 9/1969 | Utech et al. . | |
| 3,477,494 | 11/1969 | Burkart et al. . | |
| 3,702,152 | 11/1972 | Bryson | 164/487 X |
| 3,842,895 | 10/1974 | Mehrabian et al. . | |
| 4,071,072 | 1/1978 | McCubbin | 164/487 |
| 4,214,624 | 7/1980 | Foye et al. | 164/487 |

FOREIGN PATENT DOCUMENTS

| | | |
|---|---|---|
| 1583602 | 9/1970 | Fed. Rep. of Germany . |
| 58-63566 | 9/1983 | Japan . |
| 187255 | 10/1966 | U.S.S.R. . |

OTHER PUBLICATIONS

"Dendrite Cell Size", R. E. Spear and G. R. Gardner, *A.F.S. Transactions;* 71; 1963; pp. 209–215.

"Macrosegregation: Part I", M. C. Flemings and G. E. Nereo, *Transactions of the Metallurgical Society of AIME,* vol. 239, Sep. 1967, pp. 1449–1461.

"Interdendritic Fluid Flow and Macrosegregation; Influence of Gravity", R. Mehrabian, M. Keane, and M. C. Flemings, *Metallurgical Transactions,* vol. 1, May 1970, pp. 1209–1220.

"Macrosegregation in Aluminum Alloy Ingot Cast by the Semicontinuous Direct Chill Method", H. Yu and D. A. Granger, *Symposium Held at NASA Lewis Research Center,* Cleveland, Oh., Sep. 12–13, 1984, pp. 157–168.

*Primary Examiner*—Kuang Y. Lin

*Attorney, Agent, or Firm*—Thomas J. Connelly

[57] ABSTRACT

A process and an apparatus are disclosed for reducing macrosegregation adjacent to a longitudinal centerline of a solidified cast body. Such cast bodies are preferably large size aluminum alloy ingots made in a continuous casting mold. The ingot is formed from a pool of molten metal having flow currents present therein. The flow currents tend to detach the tips of dendrites growing around the edge of the liquid pool and transport them to the center of the ingot. These detached dendrites, which are lean in eutectic elements, cause negative macrosegregation of the cast ingot. The process includes the step of weakening the magnitude of the flow currents within the liquid pool by placing a mechanical damper therein. The mechanical damper reduces shear acting on the dendrites and minimizes detachment and transport of dendrite particles to the center of the solidified body. The magnitude of the flow currents can also be reduced by increasing the metal head of the liquid pool or by reducing the kinetic energy of newly added molten metal. The apparatus claims a mechanical damper consisting of two or more parallel plates or concentric rings which extensively increases the surface area within the liquid pool. The plates or rings are spaced apart so as to provide flow passages for the molten metal which encourages laminar flow and tends to reduce turbulence within the pool.

23 Claims, 5 Drawing Figures

PROCESS AND APPARATUS FOR REDUCING MACROSEGREGATION ADJACENT TO A LONGITUDINAL CENTERLINE OF A SOLIDIFIED BODY

CROSS-REFERENCE TO RELATED APPLICATION

This application is a continuation-in-part of Ser. No. 774,887, filed Sept. 11, 1985, now abandoned.

FIELD OF THE INVENTION

This invention relates to a process and apparatus for reducing macrosegregation adjacent to a longitudinal centerline of a solidified body and more particularly to reducing macrosegregation in the central portion of an aluminum alloy ingot.

BACKGROUND OF THE INVENTION

Macrosegregation is one parameter used to measure the properties of a finished product so as to determine its future usefulness. Changes in macrosegregation across commercial size castings, particularly aluminum alloy ingots produced in a continuous casting mold, make it difficult to maintain a particular concentration of alloying elements within specification throughout the entire cross section or thickness of a casting. The degree of macrosegregation in a casting will be influenced to a large extent by the cast thickness, by alloying elements and their concentrations, and by the process used in casting the ingots. Laboratory experimentation has shown that as the thickness or diameter of a cast ingot increases, the degree of macrosegregation will also increase. This is a direct result of unavoidable variations in the solidification brought about by varying heat extraction rates from location to location within the ingot cross section and by convective forces in the unsolidified portion of the ingot. In a continuous casting process such as a direct chill casting process for an aluminum alloy ingot, it is customary to have a liquid zone followed by a mushy zone which in turn is followed by a solid zone, all of which are arranged in a vertical orientation. The mold is water cooled and therefore the outer surface tends to solidify prior to the central portion adjacent to the longitudinal centerline. Dendrites which are lean in eutectic elements tend to grow about the periphery of the liquid zone. The presence of strong convection currents within the liquid zone causes the tips of the dendrites to detach and be carried by the convection currents to the center of the liquid zone. As the dendrites move toward the center, they grow isothermally within the thermal boundary layer and are finally frozen adjacent to the longitudinal centerline. Since the dendrites are lean in eutectic material, they cause the final product to exhibit a low concentration of the eutectic elements in its central portion. This low concentration causes a large variation in macrosegregation of the ingot itself which is undesirable for the reasons stated above.

Up until now, no one has been able to reduce macrosegregation adjacent to a longitudinal centerline of a commercial size ingot. U.S. Pat. No. 3,842,895, issued to Mehrabian et al, attempted to reduce channel segregation in the mushy zone of a casting by controlling heat flow during solidification. Mehrabian teaches that this can be accomplished by controlling the depth of the mushy zone by using a transverse magnetic field of the order of 2,000 gauss. By increasing the temperature of the liquid melt around the region of the liquidus-isotherm, while maintaining substantially the velocity of the solidus-isotherm, the depth of the mushy zone is supposedly kept at a desired level. Mehrabian does not teach reduction of macrosegregation along the longitudinal centerline of a casting by controlling convection currents with a mechanical damper positioned within the liquid pool of the mold. Three other patents, German Pat. No. 1,583,602, Russian Pat. No. 187,255 and Japanese Pat. No. 58-163,566, also disclose using an electromagnetic field to suppress the convection flow of a molten metal. However, none describe the use of non-electromagnetic means to control convection currents within the liquid pool of the mold.

Now a process and apparatus have been invented which reduces macrosegregation adjacent to a longitudinal centerline of a solidified casting.

SUMMARY OF THE INVENTION

Briefly, this invention relates to a process and apparatus for reducing macrosegregation adjacent to a longitudinal centerline of a solidified body such as an aluminum alloy casting. The solidified body can be produced in a continuous casting mold wherein a liquid pool of molten metal is chilled to form a solidified casting. The liquid pool solidifies from the outer perimeter by the formation of dendrites which are lean in eutectic elements. Flow currents, which are present within the pool, tend to cause the tips of the dendrites to detach and be carried toward the center of the pool. As the dendrites are transported, they grow isothermally within the thermal boundary layer until they solidify at the center of the casting.

The present process involves the step of weakening the magnitude of the flow currents within the liquid pool by increasing the internal friction of the pool so as to reduce shear stress acting on the dendrites. By weakening the flow currents, one can minimize the detachment of the dendrites and thereby reduce the transport of such particles to the center of the solidified body. In so doing, the macrosegregation of the finished casting does not exhibit the low concentration of eutectic elements at its center and therefore diminishes the overall change in composition exhibited by the finished casting. The apparatus for reducing the macrosegregation of a solidified body is a mechanical damper which is positioned a set distance within the liquid pool. The damper contains passages through which the molten metal can flow. The surfaces forming the passages increase the internal friction within the pool, reduces the Reynolds number and also aids in maintaining laminar flow within the liquid pool. By increasing the friction, one can reduce the velocity of the convection currents and thereby prevent the tips of the dendrites from being detached and transported toward the center of the finished casting.

The general object of this invention is to provide a process for reducing macrosegregation adjacent to a longitudinal centerline of a solidified body. A more specific object of this invention is to reduce macrosegregation in an aluminum alloy ingot cast in a continuous casting mold.

Another object of this invention is to provide a simple, economical and commercially feasible process for reducing macrosegregation adjacent to the longitudinal centerline of a large casting by controlling the magnitude of the flow currents within the liquid pool of the mold.

Still another object of this invention is to provide a process for increasing the internal friction within the liquid pool of a continuous casting mold so as to reduce macrosegregation across the thickness or diameter of the finished ingot.

Still further, an object of this invention is to provide an apparatus for reducing macrosegregation in a solidified casting by placing a mechanical damper in the liquid pool.

Still another object of this invention is to employ a mechanical damper having passageways formed therein through which molten metal can flow so as to increase the internal friction of the liquid pool and reduce turbulence therein.

Other objects and advantages of the present invention will become more apparent to those skilled in the art in view of the following description and the accompanying drawings.

DETAILED DESCRIPTION OF THE PREFERRED EMBODIMENTS

Figure 1:
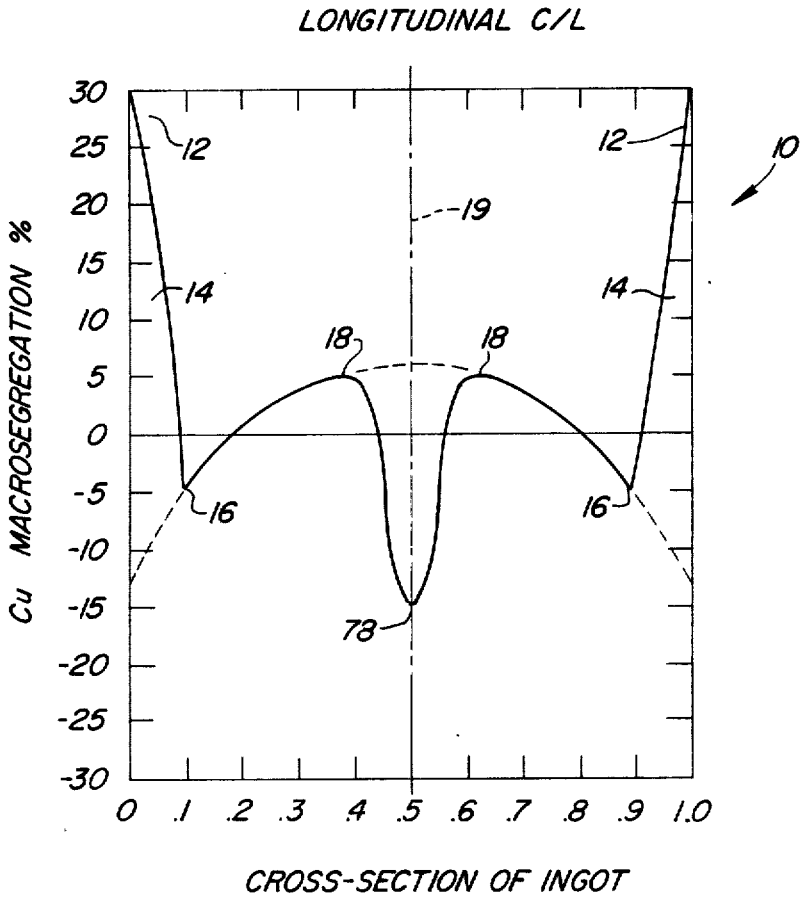
FIG. 1 is a graph setting forth an example of macrosegregation across the thickness of a commercial size aluminum-copper alloy ingot.

Referring to FIG. 1, segregation, which represents the non-homogeneous distribution of alloying elements in a metallurgical structure, is characteristic of all commercially produced castings. Macrosegregation represents distribution of the alloying elements across the thickness of the billet or ingot which is cast. For purposes of discussion, commercial size aluminum alloy ingots are cast in a continuous process such as is taught in U.S. Pat. Nos. 3,464,812 and 3,477,494. Although the casting process is referred to as continuous, those skilled in the art know that it is realistically semi-continuous in that once the ingot is formed to a particular length, preferably about 30 feet, the casting operation ceases. At this point the casting is removed and the process is repeated.

It is known that aluminum alloys are not homogeneous on either the macro or micro scale. During solidification, the form and distribution of alloying elements vary according to physical laws so that concentrations of alloying elements will vary from one point to another. In FIG. 1 the dotted line represents the theoretical distribution pattern on a macrosegregation scale taken across the thickness of a commercial size aluminum-copper alloy ingot. A commercial size ingot is one having a thickness of at least 18 inches in diameter for a circular ingot and at least 16 inches in thickness for a rectangular ingot. Although FIG. 1 represents an aluminum-copper alloy, similar graphs will be obtained for alloys containing lithium, manganese, zinc, magnesium and silicon. The degree of macrosegregation in an alloy will be influenced to a large extent by cast thickness, by alloying elements and their concentration, and by the process used in casting the ingot. Other factors that also influence macrosegregation are the casting rate, the flow between the liquid, mushy and solid zones of the casting, gravity, method and manner of introducing additional molten alloy and the shrinkage rate in relation to the feeding rate of the alloy.

Experimentation has shown that the solid line in FIG. 1 represents macrosegregation across the thickness of an aluminum-copper ingot 10. The outside surfaces of the aluminum-copper ingot 10 will be rich in eutectic elements, i.e., copper, as indicated by the numeral 12. This high percent of copper at the surface occurs upon the exuding of the richer concentration of copper liquid out through the porous surface. Such action continues to form a subsurface enrichment, denoted by 14, until a depletion point 16 occurs. This is known as inverse segregation. The concentration drops rapidly from the surface to the depletion point 16 within a few centimeters from the surface. The depletion point 16 will be located on the theoretical macrosegregation distribution line. Inward from the depletion point 16, the solidification of the copper will exhibit a positive segregation until it approaches a point 18 adjacent to the longitudinal centerline 19 of the ingot 10. At point 18, instead of having the macrosegregation of the aluminum-copper alloy follow the theoretical distribution pattern, it has been found that negative segregation actually occurs because the dendrites which are lean in copper were transported there. This pattern of segregation in an aluminum-copper alloy results from the manner in which the liquid moves within the mushy zone of the solidifying ingot and the transportation of solute lean dendrites. Elements other than copper may show a slightly different pattern of segregation. The points of high and low concentrations may vary both in location and amount. It has also been found that as the thickness or diameter of the ingot 10 increases, the degree of macrosegregation will also increase. This is a direct result of variations in solidification brought about by varying heat extraction rates from location to location within the cross-section of the ingot 10 and by convective forces in the unsolidified portion of the ingot 10. Such large variations of macrosegregation across the thickness of the ingot 10 could be detrimental to the end use of the product since the center portion of the ingot 10 may be outside the specification required by the ultimate user.

Figure 2:
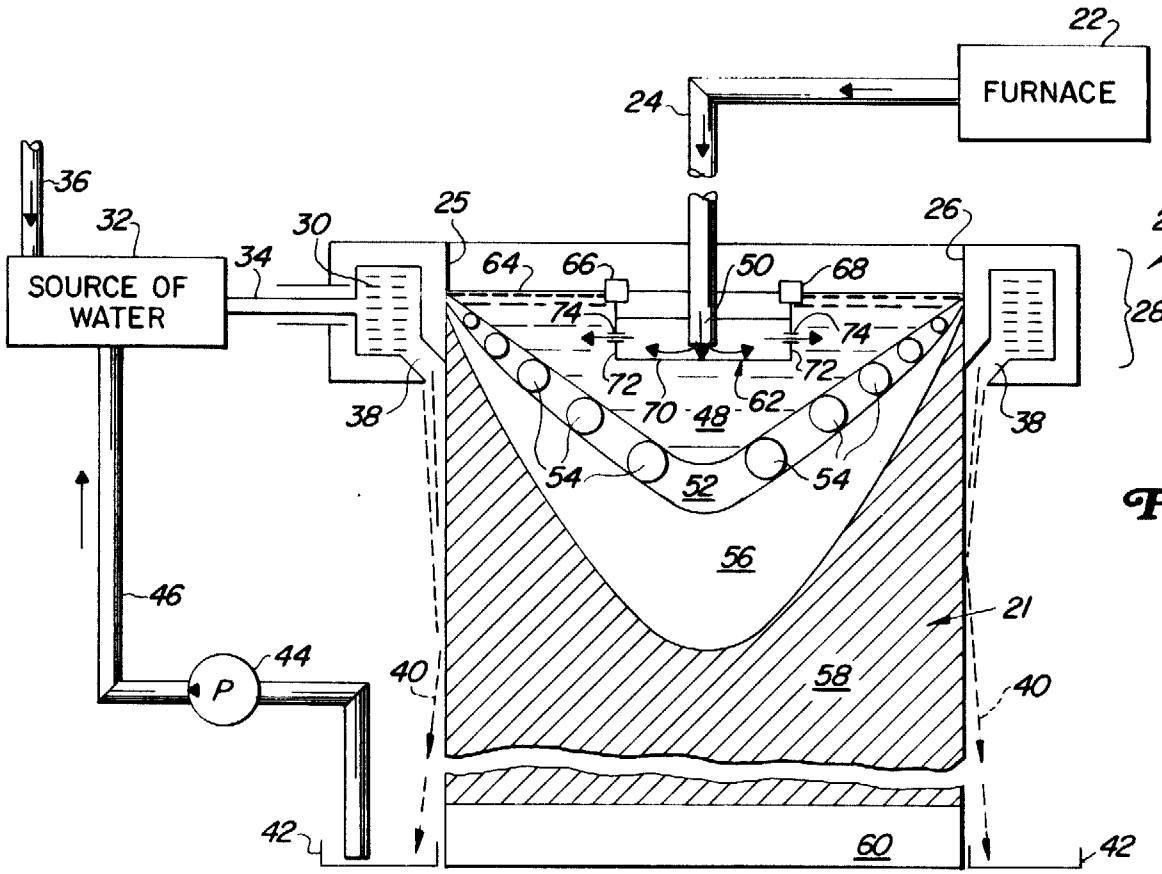
FIG. 2 is a cross-sectional view of a continuous mold with a rectangular ingot being cast therein and illustrating the transport and isothermally growing dendrites toward the center of the ingot.

Referring to FIG. 2, a direct chill ingot casting mold 20 is shown for forming an elongated rectangular ingot 21. For all essential purposes, any type of a continuous or semi-continuous casting mold, including a hot top casting mold and a direct chill (D.C.) mold, can produce elongated ingots having either a circular, square or rectangular cross section. It should be noted that batch type casting molds will also produce ingots having similar macrosegregation but to a limited extent due to the absence of strong convection currents. Molten metal, such as an aluminum alloy which has been raised to a desired temperature in a furnace 22, is directed via a conduit 24 toward the internal walls 25 and 26 of the mold 20. For aluminum-copper alloy 2024, the material is raised to a temperature of approximately 1180° F. in the furnace 22 and has a solidification temperature of approximately 935° F.

The mold 20 has a ring-like structure 28 positioned near its top which encloses a cooling mechanism 30. Cooling water 40 is supplied to the cooling mechanism 30 from a supply source 32 via a supply line 34. The water is cooled to a desired temperature and is then directed toward the interior of the mold 20 through a plurality of outlets 38. It is common in a direct chill mold to have a plurality of spray nozzles connected to the cooling mechanism 30 such that the nozzles will spray cooling water or a specific type of coolant along the downwardly extending outer surface of the solidifying ingot 21. The cooling water 40 is collected in a reservoir 42 located at the bottom of the mold 20. The cooling water 40 is then pumped via a pump 44 through a return line 46 to the source of water 32. It should be noted that fresh water or lubricant can be added to the system from an outside source as needed.

The ingot 21 formed within the direct chill casting mold 20 contains several stages. The first stage is a liquid pool 48, which in a vertically oriented mold appears as the top layer in a frusto-conical configuration. The liquid pool 48 consists of molten metal which is introduced from a spout 50 attached to the conduit 24. Immediately below the liquid pool 48 is a thermal boundary layer 52 wherein isothermal dendrite growth occurs. Dendrites have a tree-like crystal configuration and are nucleated on or in a metal by heterogeneous nuclei. The growth of the dendrites is depicted by enlarging circular spheres 54 as the dendrites 54 are carried by flow currents toward the center of the ingot 21. Directly below the thermal boundary layer 52 is a mushy zone 56 which contains a plurality of dendrites surrounded by liquid material. Below the mushy zone 56 is a solid zone 58 wherein solidification has taken place in the ingot 21 and macrosegregation is set.

The direct chill continuous casting mold 20 also has a bottom support 60 which is movable downward as the ingot 21 is being formed. When the bottom support 60 reaches the predetermined position (when a predetermined length of ingot is cast), introduction of molten metal into the mold 20 is stopped. The liquid pool 48 is allowed to solidify and then the entire ingot 21 is withdrawn. The bottom support 60 is then moved up close to the bottom of the ring-like structure 28 and the process starts over again.

In FIG. 2, the continuous mold 20 is shown having a pan 62 positioned below the spout 50. The pan 62 is supported a set distance below a top surface 64 of the liquid pool 48 by a pair of floats 66 and 68. The pan 62 contains a solid bottom surface 70 and one or more walls 72 having one or more apertures 74 formed therein. The pan 62 can be of any particular configuration but a circular, square or rectangular configuration is preferred. The pan 62 acts as a shut-off or flow restriction mechanism when the liquid pool 48 rises too high within the mold 20. When this occurs, the bottom surface 70 will contact the open end of the spout 50 and shut off flow. This will occur for the floats 66 and 68 will move with any rise or fall of the top surface 64 of the molten metal. Likewise, if the liquid pool 48 should drop, the pan 62 will move downward providing less restriction to fluid flow. The solid bottom surface 70 directs newly added molten metal into the liquid pool. The addition of kinetic energy through the dispensing of additional molten metal into the liquid pool 48 or the creation of turbulence within the liquid pool 48 should be avoided since it will affect the growth and detachment of the tips of the dendrites 54.

It should be noted that the size and shape of the frusto-conical shaped crater comprising the liquid pool 48 and the mushy zone 56 is a function of the liquid metal temperature, the casting speed, the ingot shape and the cross-sectional area of the ingot 21, as well as the effective heat removal rate. The shape of the mushy zone 56 is also influenced by the kind of alloy being cast. Different phases (components formed from aluminum and the alloying elements) in the molten metal solidify at different temperatures. Since different alloys contain varying amounts and combinations of alloying elements, the temperature range over which solidification takes place will vary from alloy to alloy.

The degree of macrosegregation can be such that the composition in certain regions across the thickness of a cast ingot may be outside the registered limits established for the alloys. Thus, on the surface of the ingot, the concentration of the eutectic element may exceed the upper limit while in the center of the ingot the concentration may be below the lower limit. Such variations in macrosegregation can cause problems in the fabricated products produced from that particular cast ingot.

Flow currents 76 (see FIG. 4) which include both natural and forced convection currents are present during the formation of the ingot 21. Forced convection currents are caused by the pouring velocity of newly added metal while natural convection currents are temperature driven such as by a temperature gradient. The flow currents 76 tend to increase in strength as the thickness of the casting increases. In casting a large ingot, the convection currents 76 can be at least one order of magnitude higher than the casting rate. The dendrites 54, formed at the liquidus isotherm and detached by convective currents 76, are lean in eutectic elements such as lithium, copper, zinc, iron, magnesium or silicon, and therefore have a higher melting point than the molten metal which comprises the liquid pool 48. With the higher melting point, the dendrites 54 grow within the thermal boundary layer 52 at substantially the same composition (i.e., lean in eutectic elements). The dendrites are susceptible to being detached and transported to the center of the liquid pool 48 by the flow currents 76. The dendrites 54 tend to grow as they are transported toward the center of the liquid pool 48 and then freeze in an area adjacent to the longitudinal centerline 19. It is this phenomenon which apparently causes a negative segregation point 78 (see FIG. 1) located at the center of the ingot 21. The dendrites 54, which are lean in eutectic elements, tend to freeze adjacent to the longitudinal centerline 19 thereby giving the ingot 21 a lean eutectic composition in the area adjacent thereto. This lean or negative segregation expressed in a percentage is much lower than the percent of lean eutectic occurring at the depletion point 16, as shown in FIG. 1.

Figure 3:
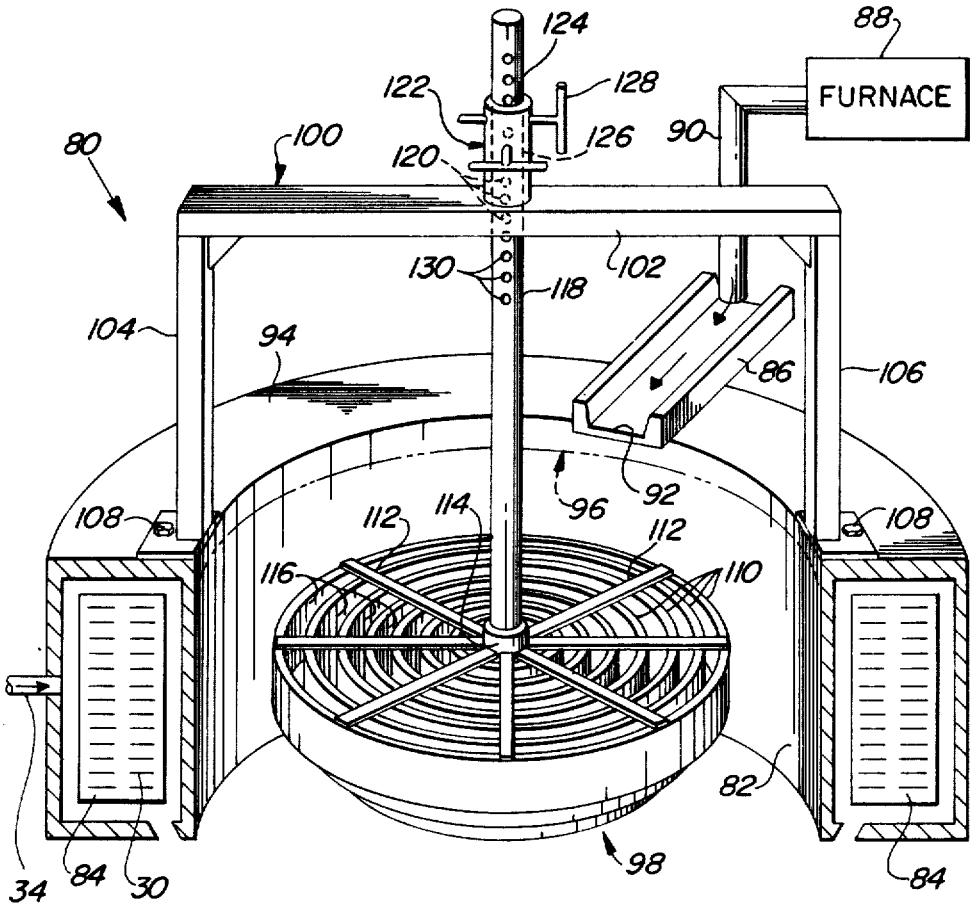
FIG. 3 is an isometric assembly view of a circularly configured continuous mold having a mechanical damper positioned therein.

Referring now to FIG. 3, a continuous casting mold 80 is depicted having a circular cross section with an inner wall 82 surrounded by a cooling chamber 84. An inlet trough 86 for supplying molten metal is fluidly connected to a furnace 88 by a conduit 90. Molten metal, preferably an aluminum alloy, is directed through the trough 86 to the perimeter of the inner wall 82. The level at which the trough 86 is in fluid communication with the inner wall 82 can vary but preferably a bottom surface 92 of the trough 86 will be below a top surface 94 of the mold 80. This will permit a liquid level 96 which will be above the lower surface 92 of the trough 86 yet below the top surface 94 of the mold 80. Positioned within the mold 80 is a mechanical damper 98 which is adjustable relative to the top surface 94 via a support structure 100. The support structure 100 can consist of a horizontal bar 102 supported by a pair of vertical legs 104 and 106 which are attached to the mold 80 via bolt 108. It should be noted that any type of support structure can be utilized such as an overhanging I-beam.

The mechanical damper 98 preferably has a configuration which is similar to the cross-sectional configuration of the mold in which it is positioned. In FIG. 3, since the continuous mold 80 has a circular cross-sectional configuration, the damper 98 is also circular in cross section. The damper 98 includes at least two and preferably a plurality of circular rings 110 which are connected together by one or more radial members 112 and which are joined at a center location by a circular disc or hub 114. The circular rings 110 are constructed of a very thin gauge material such as 1/32 inch stainless steel so as to minimize thermal inertia which might cause the molten metal to solidify thereon. The circular rings 110 are concentrically aligned and preferably contain parallel surfaces with the inner rings having a greater height dimension than each adjacent outer ring. This feature gives the damper 98 a frusto-conical appearance and is designed to approximate the shape of the liquid pool 48 shown in FIG. 1. The circular rings 110 are arranged to provide at least one and preferably a plurality of passageways 116 therebetween through which the molten metal can flow. It is also advantageous to coat the rings 110 with a thin layer of refractory material to minimize or prevent the molten metal from corroding or attacking the rings themselves. One such method of doing this is to plasma spray an alumina coating onto the circular rings 110. Another option is to construct the rings 110 entirely from a particular refractory material.

The mechanical damper 98 also includes an outwardly extending support rod 118 which passes through an opening 120 formed in the horizontal bracket 102 of the support structure 100. The support rod 118 is preferably adjustably mounted to the support structure 100. The adjustable feature includes a collar 122 having an elongated central bore 124 formed therein. A second transverse bore 126 intersects the first bore 124 such that a pin 128 can be inserted therein. A plurality of apertures 130 formed horizontally through the support rod 118 are spaced vertically therealong so as to provide an opening through which the pin 128 can be inserted. It should be noted that FIG. 3 represents a basic way of adjustably mounting the mechanical damper 98 within the mold 80. Many other types of attachment means can be used as are well known to those skilled in the art.

Figure 4:
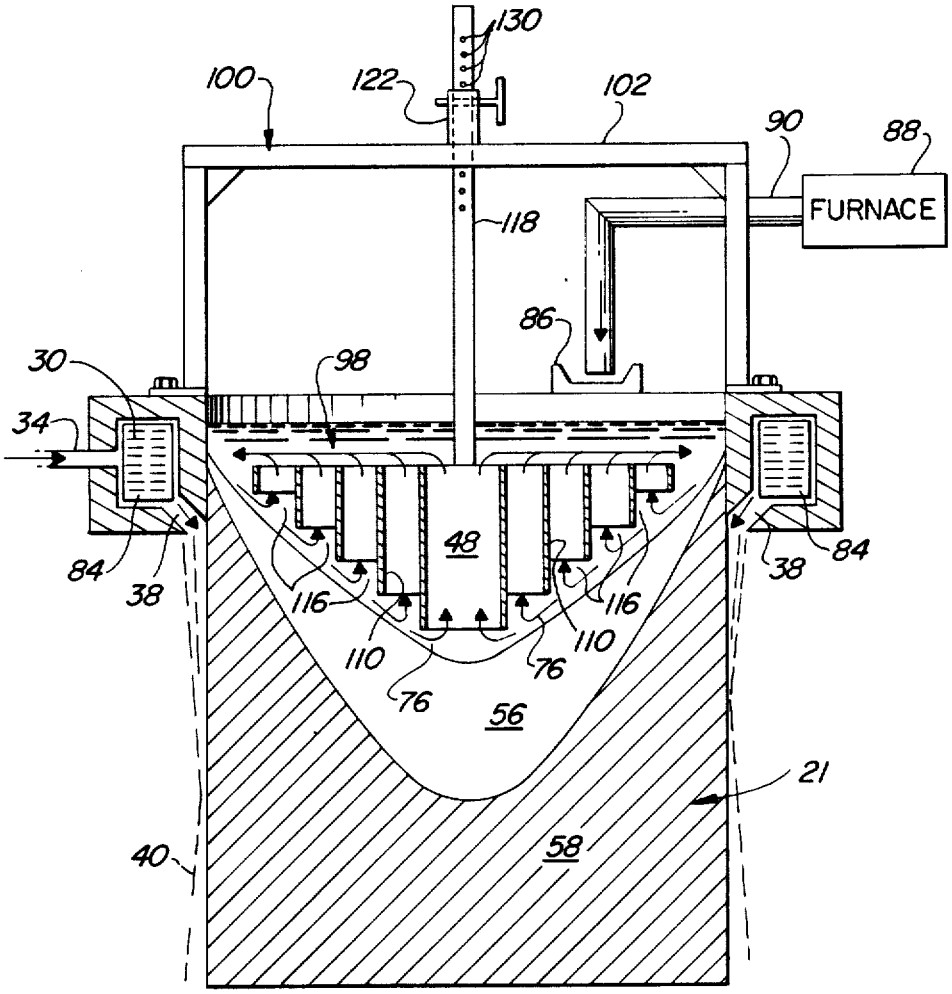
FIG. 4 is a schematic diagram of a cylindrical ingot being cast in a continuous mold having a damper positioned in the liquid pool of molten metal.

Referring to FIG. 4, a schematic of the mold 80 shown in FIG. 3 is depicted with like parts being referred to by the same numbers. In a continuous casting mold, as the depth of the liquid pool 48 increases and as the cross-sectional thickness of the ingot 21 increases, the convection currents usually also increase. By placing the mechanical damper 98 within the liquid pool 48 but just above the mushy zone 56, one can increase the internal friction therein. Because the circular rings 110 are solid and contain an extensive surface area, they provide resistance to the flow currents 76. This increased frictional resistance reduces the velocity and the intensity of the flow currents 76 and thereby reduces turbulence within the liquid pool 48. The reduction of turbulence minimizes the chance that the tips of the dendrites 54 will break and be transported toward the center portion of the ingot 21. This has the effect of reducing or changing the variation of macrosegregation adjacent to the longitudinal centerline of the ingot 21. Furthermore, the spacing between the circular rings 110 is preferably small such that the passageways 116 will have a thickness of about 1 or 2 inches, and this promotes laminar flow of molten metal therethrough. The laminar or streamline flow of the molten metal aids in reducing turbulence within the liquid pool 48. The laminar flow is also advantageous in that it generates lower shear stresses than would turbulent flow at a given flow rate. With lower shear stresses, fewer dendrites will break and detach from these branch-like structures. It should be noted that the width of the passageways 116 between the circular rings 110 can vary in dimensions depending upon the size and shape of the mold as well as the type of alloy being cast.

The damper 98 also serves a second purpose in that it minimizes stirring or agitation of the molten metal within the liquid pool 48 which can occur with the introduction of additional molten metal from the furnace 88. While stirring itself might reduce ingot center macrosegregation and produce a more homogeneous ingot, the presence of turbulent currents tends to offset these advantages by breaking more of the dendrites. The detaching or breaking of the dendrite tips from the tree-like branches and their transport to the center of the ingot also produces a coarse or more non-uniform grain structure which could possibly detract from the quality of the finished ingot.

Figure 5:
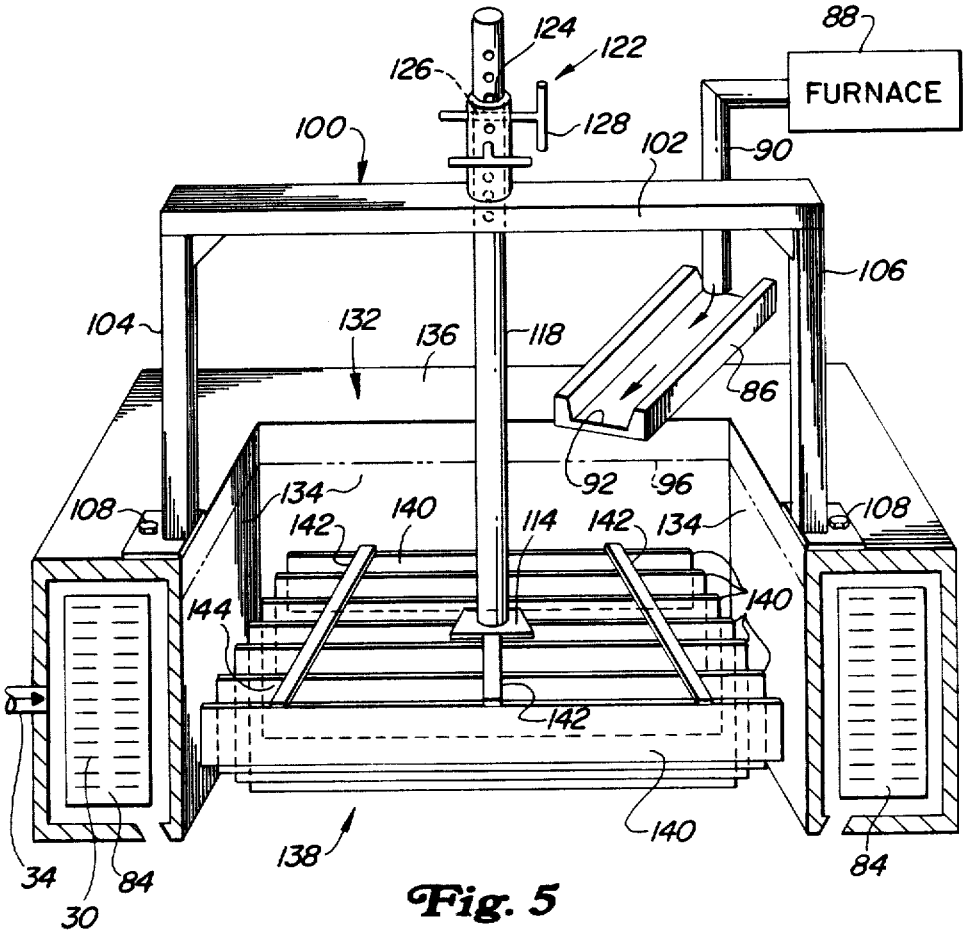
FIG. 5 is an isometric view of a rectangularly configured continuous mold having a mechanical damper positioned therein.

Referring now to FIG. 5, an alternative embodiment is shown using a continuous mold 132 having a rectangular cross-sectional area with four inner walls 134 and a top wall 136. The other structural features of the mold 132 remain the same as those shown in FIG. 3. Positioned within the mold 132 is a mechanical damper 138 which contains at least two and preferably a plurality of parallel plates 140 connected together by one or more support members 142. The central support member 142 can intersect the hub 114 which has the support rod 118 connected thereto. The parallel plates 140 are spaced apart so as to form one or more passageways 144 therebetween. The purpose of the passageways 144 is to permit molten metal within the liquid pool 48 to flow therebetween, thereby reducing turbulence and minimizing the strength of the flow currents. The operation of the mechanical damper 138 is similar to that of the circular damper 98. The rectangular damper 138 works best when its configuration approaches that of the liquid pool 48 and therefore the center or inner plate 140 should have a height dimension greater than each of the adjacent outer plates 140 as is shown in FIG. 5.

While the use of a mechanical damper represents one preferred method of reducing center macrosegregation in a cast ingot, it should be noted that other means can be employed to retard the mass transit of dendrite particles toward the ingot center. This invention also teaches that the internal friction within the liquid pool 48 can be increased by increasing the metal head above the liquid pool 48. The metal head is defined as the metal level above the chill mold. The metal is surrounded by an insulator and has little or no heat loss. By increasing the head of the liquid pool 48, one can increase the internal friction thereof and this will weaken the magnitude of the flow currents 76. It should be noted that a mechanical damper is able to weaken the magnitude of the flow current 76 within the liquid pool by increasing the internal friction thereof without disturbing the shape or composition of the mushy zone 56. By increasing the metal head on the liquid pool 48, the shape of the mushy zone 56 could possibly be altered depending upon the size and shape of the ingot being cast. A third means of reducing the internal friction of the liquid pool 48 is to minimize the kinetic energy contained in the incoming molten metal. One method of doing this is to add molten metal through a trough 86 positioned evenly with the top surface 96 of the liquid within the mold 80. The newly added molten metal will then be low in kinetic energy for it will not be dropping a set distance into the liquid pool 48. The use of a pan as shown in FIG. 2 or baffles also assist in decreasing the kinetic energy of the newly added molten metal. It should be emphasized that no matter how the molten metal is added, it should be added in a non-turbulent manner. A laminar flow coming into the liquid pool 48 is less likely to add to the internal friction of the pool 48. The novel feature in this invention is to weaken the magnitude of the existing flow currents without creating a turbulent or agitating environment. For this reason a mechanical means is preferable to a electromagnetic means. In most electromagnetic devices, a force can be created to minimize or weaken the convection current but eddy currents are induced which travel transversely or at an angle to the convection current and tend to create turbulence within the mold.

While the invention has been described in conjunction with several specific embodiments, it is to be understood that many alternatives, modifications and variations will be apparent to those skilled in the art in light of the aforegoing description. Accordingly, this invention is intended to embrace all such alternatives, modifications and variations which fall within the spirit and scope of the appended claims.

We claim:

1. A process for reducing macrosegregation adjacent to a centerline of a solidified body, said body being formed from a pool of molten metal having flow currents present therein, said liquid pool having dendrites which are lean in eutectic elements growing about the periphery thereof as said molten metal solidifies, said process comprising the step of weakening the magnitude of said flow currents by placing a mechanical damper in said pool, said damper including at least three plates connected together to form at least two passageways therebetween through which said molten metal can flow, said damper reducing shear stress acting on the tips of said dendrites and thereby reducing breakage and transport of particles of said dendrites to the center of said solidified body.

2. The process of claim 1 wherein said solidified body is formed in a continuous casting mold.

3. The process of claim 1 wherein said solidified body is formed in a direct chill casting mold.

4. A process for reducing macrosegregation adjacent to a longitudinal centerline of a solidified body formed from a liquid pool of molten metal in a continuous mold, said liquid pool having dendrites which are lean in eutectic elements growing about the periphery thereof as said molten metal solidifies and having both natural and forced convection currents present therein, said process comprising the step of increasing the frictional surface area within said liquid pool to slow the velocity of said convection currents by placing a damper in said pool, said damper having at least two circular rings with a passageway formed therebetween through which said molten metal can flow, said damper providing an increased surface area for reducing turbulence within said liquid pool and minimizing the breakage of the tips of said dendrites and the transport of particles of said dendrites to the center of said solidified body.

5. The process of claim 4 wherein said dendrites are leaner in eutectic elements than said liquid pool.

6. The process of claim 4 wherein said solidified body is a cast aluminum alloy.

7. A process for reducing macrosegregation adjacent to a longitudinal centerline of a solidified body formed from a liquid pool of molten metal, said liquid pool having strong convection currents present therein, and a mushy zone formed between said liquid pool and said solidified body, said process comprising the step of weakening the magnitude of said strong convection currents by placing a mechanical damper in said liquid pool to increase the internal friction therein without disturbing said mushy zone, said damper having at least three plates with a passageway formed between adjacent plates through which said molten metal can flow and attachment means for adjusting the depth to which said damper is positioned within said liquid pool.

8. The process of claim 7 wherein said solidified body is an aluminum alloy cast at a predetermined rate into a large ingot and said strong convection currents are at least one order of magnitude higher than said casting rate.

9. The process of claim 7 wherein said solidified body is formed by continuous casting.

10. A process for changing macrosegregation along a longitudinal centerline of a solidified aluminum alloy ingot formed in a continuous casting mold from a liquid poolof molten aluminum alloy having convection flow currents present therein, said liquid pool having dendrites which are lean in eutectic elements growing about the periphery thereof as said molten aluminum alloy solidifies, said process comprising the steps of:

(a) placing a mechanical damper in said liquid pool to increase the internal friction therein, said damper including at least three plates connected together to form at least two passageways therebetween through which said molten aluminum alloy can flow; and (b) adjusting said damper to a predetermined depth within said liquid pool such that the magnitude of said convection flow currents are weakened to a desired level, the weakening of said flow currents causing a reduction of shear stress within said liquid pool which acts on the tips of said dendrites and thereby reduces the number of particles of dendrites which are transported to the central portion of said solidified ingot.

11. An apparatus for reducing macrosegregation in a solidified body formed in a mold from a liquid pool of molten metal having flow currents present therein, said apparatus comprising:

(a) a support structure positioned above said mold;

(b) a damper including at least three plates with a passageway formed between adjacent plates through which said molten can flow; and (c) attachment means for securing said damper to said support structure whereby said damper is positioned within said liquid pool at a desired depth to weaken said flow currents.

12. The apparatus of claim 11 wherein said damper includes a plurality of parallel spaced apart plates.

13. The apparatus of claim 12 wherein each of said parallel plates is rectangular.

14. The apparatus of claim 23 wherein said plates increase in size as one approaches a center plane which passes vertically through said damper.

15. The apparatus of claim 11 wherein said plates are coated with a refractory metal.

16. An apparatus for reducing macrosegregation adjacent to a longitudinal centerline of a solidified body formed in a continuous mold from a liquid pool of molten metal having flow currents present therein, said apparatus comprising:

(a) a support structure attached to said mold;

(b) a damper including at least two circular rings with a passageway formed therebetween through which said molten metal can flow; and (c) attachment means for securing said damper to said support structure whereby said damper is positioned within said liquid pool at a desired depth to weaken said flow currents.

17. The apparatus of claim 16 wherein said damper includes a plurality of concentrically spaced rings.

18. The apparatus of claim 17 wherein said concentric rings are connected together by at least one radial member.

19. The apparatus of claim 17 wherein said rings are aligned parallel to one another.

20. The apparatus of claim 16 wherein said rings are coated with a refractory material.

21. An apparatus for reducing macrosegregation adjacent to a longitudinal centerline of an elongated circular ingot formed in a continuous mold from a liquid pool of molten aluminum alloy having flow currents present therein, said apparatus comprising:

(a) a support structure positioned above said mold:

(b) a damper including at least two circular rings of different diameters connected together to form at least one passageway therebetween through which said molten aluminum alloy can flow; and (c) a support rod connected to and extending out of said rings and being adjustably attached to said support structure for positioning said damper at a desired depth within said liquid pool to weaken said flow currents.

22. An apparatus for reducing macrosegregation along a longitudinal centerline of a solidified body formed in a continuous mold from a liquid pool of molten metal having flow currents present therein, and a mushy zone formed between said liquid pool and said solidified body, said apparatus comprising:

(a) a support structure positioned above said mold;

(b) a damper having at least three circular rings of decreasing diameters connected together to form a pair of passageways therebetween through which said molten metal can flow;

(c) a support rod connected to and extending upward from said damper; and (d) attachment means for securing said support rod to said support structure to enable said damper to be positioned within said liquid pool at a desired height above said mushy zone whereby said damper increases the surface area within said liquid pool and weakens said flow currents.

23. An apparatus for reducing macrosegregation adjacent to a longitudinal centerline of an elongated rectangular ingot formed in a continuous mold from a liquid pool of molten aluminum alloy having flow currents therein, said apparatus comprising;

(a) a support structure positioned above said mold;

(b) a damper including at least three plates connected together to form at least two passageways therebetween through which said molten aluminum alloy can flow; and (c) a support rod connected to and extending out of said plates and being adjustably attached to said support structure for positioning said damper at a desired depth within said liquid pool to weaken said flow currents.

* * * * *

UNITED STATES PATENT AND TRADEMARK OFFICE

CERTIFICATE OF CORRECTION

PATENT NO. : 4,709,747

DATED : December 1, 1987

INVENTOR(S) : Ho Yu and Douglas A. Granger

It is certified that error appears in the above-identified patent and that said Letters Patent is hereby corrected as shown below:

| | |
|---|---|
| Under References Cited: | Change "58-63566" to --58-163566--. |
| Abstract, line 14 | After "shear" insert --stress--. |
| Claim 11, Col. 10, line 66 | After "molten" insert --metal--. |
| Claim 14, Col. 11, line 7 | Change "23" to --13--. |
| Claim 23, Col. 12, line 30 | After "currents" insert --present--. |

Signed and Sealed this

Twenty-first Day of June, 1988

*Attest:*

DONALD J. QUIGG

*Attesting Officer*

*Commissioner of Patents and Trademarks*